US009747842B2

(12) United States Patent
Kang et al.

(10) Patent No.: US 9,747,842 B2
(45) Date of Patent: Aug. 29, 2017

(54) ORGANIC LIGHT EMITTING DISPLAY

(71) Applicant: LG DISPLAY CO., LTD., Seoul (KR)

(72) Inventors: Haeyoon Kang, Paju-si (KR); Jongsik Shim, Goyang-si (KR)

(73) Assignee: LG DISPLAY CO., LTD., Seoul (KR)

( * ) Notice: Subject to any disclaimer, the term of this patent is extended or adjusted under 35 U.S.C. 154(b) by 323 days.

(21) Appl. No.: 14/444,826

(22) Filed: Jul. 28, 2014

(65) Prior Publication Data

US 2015/0035735 A1 Feb. 5, 2015

(30) Foreign Application Priority Data

Jul. 31, 2013 (KR) ..... 10-2013-0091048

(51) Int. Cl.

*G09G 3/32* (2016.01)
*G09G 3/3291* (2016.01)
*G09G 3/3258* (2016.01)

(52) U.S. Cl.

CPC ..... *G09G 3/3291* (2013.01); *G09G 3/3258* (2013.01); *G09G 2300/0426* (2013.01); *G09G 2300/0452* (2013.01); *G09G 2310/0251* (2013.01); *G09G 2320/045* (2013.01); *G09G 2370/047* (2013.01)

(58) Field of Classification Search

None

See application file for complete search history.

(56) References Cited

U.S. PATENT DOCUMENTS

2006/0034125 A1 2/2006 Kim et al.
2009/0027310 A1* 1/2009 Kim ..... G09G 3/3233 345/76
2009/0167648 A1* 7/2009 Jeon ..... G09G 3/3233 345/76
2011/0157122 A1 6/2011 Tsai (Continued)

FOREIGN PATENT DOCUMENTS

CN 1734547 A 2/2006
CN 101471032 A 7/2009

(Continued)

*Primary Examiner* — Jennifer Mehmood
*Assistant Examiner* — Krishna Neupane
(74) *Attorney, Agent, or Firm* — Birch, Stewart, Kolasch & Birch, LLP

(57) ABSTRACT

An organic light emitting display includes a display panel including sharing pixel groups each including at least one unit pixel, a gate driving circuit generating sensing signals for initializing the unit pixels, and a data driving circuit which generates an initialization voltage to be applied to the unit pixels and outputs the initialization voltage through a plurality of initialization voltage supply channels. When the sensing signals each having a pulse width of N horizontal periods (where N is a positive integer equal to or greater than 2) are shifted while overlapping each other by (N−1) horizontal period, N initialization voltage supply channels are assigned to a plurality of vertically adjacent sharing pixel groups. N sharing pixel groups, being driven to overlap each other in response to the sensing signals, among the vertically adjacent sharing pixel groups are connected to different initialization voltage supply channels.

10 Claims, 16 Drawing Sheets

(56) References Cited

U.S. PATENT DOCUMENTS

| | | | | |
|---|---|---|---|---|
| 2011/0199357 | A1* | 8/2011 | Chung | G09G 3/3233 345/211 |
| 2013/0141316 | A1 | 6/2013 | Lee et al. | |
| 2014/0176525 | A1* | 6/2014 | Woo | G09G 3/3233 345/212 |
| 2014/0210876 | A1 | 7/2014 | Xie | |

FOREIGN PATENT DOCUMENTS

| | | | |
|---|---|---|---|
| CN | 103077955 | A | 5/2013 |
| CN | 103137067 | A | 6/2013 |
| TW | 201123958 | A1 | 7/2011 |

* cited by examiner

ORGANIC LIGHT EMITTING DISPLAY

This application claims the benefit of Korea Patent Application No. 10-2013-0091048 filed on Jul. 31, 2013, which is incorporated herein by reference for all purposes as if fully set forth herein.

BACKGROUND OF THE INVENTION

Field of the Invention

Embodiments of the invention relate to an active matrix organic light emitting display.

Discussion of the Related Art

An active matrix organic light emitting display includes organic light emitting diodes (OLEDs) that self emit light and has a fast response time, a high light emitting efficiency, a high luminance, a wide viewing angle, and the like. The OLED includes an anode electrode, a cathode electrode, and an organic compound layer formed between the anode and cathode electrodes.

Further, the organic compound layer includes a hole injection layer HIL, a hole transport layer HTL, a light emitting layer EML, an electron transport layer ETL, and an electron injection layer EIL. When a driving voltage is applied to the anode electrode and the cathode electrode, holes passing through the hole transport layer HTL and electrons passing through the electron transport layer ETL move to the light emitting layer EML and form excitons. As a result, the light emitting layer EML generates visible light.

In addition, the organic light emitting display arranges subpixels each including the OLED in a matrix form and adjusts an amount of current flowing in the OLED, thereby representing a grayscale. As shown in FIGS. 1 to 4, the OLED includes a plurality of unit pixels UPXL so as to represent a desired color. Each unit pixel UPXL includes four subpixels each representing a different color, i.e., a first subpixel having a red (R) OLED, a second subpixel having a green (G) OLED, a third subpixel having a blue (B) OLED, and a fourth subpixel having a white (W) OLED.

The unit pixels UPXL refresh a display image in each frame and implement a desired image. In this instance, in each frame, the unit pixels UPXL go through an initialization process by an initialization voltage Vinit and go through a programming process for an image refresh when the initialization voltage Vinit is applied to them. For the initialization and programming processes, the vertically adjacent unit pixels UPXL are connected to the same initialization voltage supply channel and receive the initialization voltage Vinit from a data driving circuit.

For example, as shown in FIGS. 1 and 4, vertically adjacent unit pixels UPXL on one line (for example, a first line) may be connected to a first initialization voltage supply channel CH1, vertically adjacent unit pixels UPXL on other line (for example, a second line) may be connected to a second initialization voltage supply channel CH2, and vertically adjacent unit pixels UPXL on other line (for example, a third line) may be connected to a third initialization voltage supply channel CH3.

The initialization and programming processes of the unit pixels UPXL are performed by sensing signals SEN and scan signals SCAN shown in FIG. 2. The sensing signals SEN are sequentially supplied to horizontal pixel lines through a line sequential manner. The scan signals SCAN are similarly applied. For example, as shown in FIG. 2, a scan signal SCAN(n−1) and a sensing signal SEN(n−1) may be supplied to an (n−1)th horizontal pixel line L(n−1), and a scan signal SCAN(n) and a sensing signal SEN(n) may be supplied to an nth horizontal pixel line L(n). As shown in FIG. 3, the sensing signal SEN turns on second switch TFTs ST2 included in the unit pixels UPXL and thus causes the initialization voltage Vinit received from the initialization voltage supply channel CH2 to be applied to the R, W, G, and B subpixels of the corresponding unit pixel UPXL.

A so-called sensing signal overlap drive method successively shifts sensing signals SEN to overlap each other by a predetermined period of time so as to secure a sufficient initialization period. FIG. 2 shows an example of the sensing signal overlap drive method. More specifically, FIG. 2 shows that the sensing signal SEN(n−1) and the sensing signal SEN(n) overlap each other by one horizontal period 1H (=one frame period/vertical resolution).

FIG. 3 shows a charge path of the initialization voltage Vinit in the overlap period '1H' shown in FIG. 2. As shown in FIG. 3, a second unit pixel UPXL2 of the (n−1)th horizontal pixel line L(n−1) and a first unit pixel UPXL1 of the nth horizontal pixel line Ln, which are vertically adjacent to each other, simultaneously receive the initialization voltage Vinit in the overlap period '1H' shown in FIG. 2.

However, in the sensing signal overlap drive, when a short circuit defect is generated in one of the subpixels belonging to a first unit pixel UPXL1 disposed on a predetermined horizontal pixel line, not only the remaining subpixels of the first unit pixel UPXL1, which receive the initialization voltage Vinit at the same time as the defective subpixel, but also the subpixels belonging to the second unit pixel UPXL2 vertically adjacent to the first unit pixel UPXL1 are affected by the short circuit defect. This is because the first unit pixel UPXL1 and the second unit pixel UPXL2 simultaneously operate during a predetermined period of time due to the sensing signal overlap drive.

For example, as shown in FIG. 3, a short circuit black spot (for example, a defect appearing when a green OLED does not emit light because of the short-circuit between both terminals of the green OLED) may be generated in a green (G) subpixel of a first unit pixel UPXL1 connected to an initialization voltage supply channel CH2 among the unit pixels UPXL disposed on the nth horizontal pixel line Ln.

In this instance, a low potential cell driving voltage EVSS less than the initialization voltage Vinit is applied to a source electrode of a driving thin film transistor (TFT) DT of each of red (R), white (W), and blue (B) subpixels of the first unit pixel UPXL1 in an initialization period for the initialization process and a programming period for data entry (the overlap period between the scan signal SCAN(n) and the sensing signal SEN(n) in FIG. 2). An amount of light emitted by each subpixel depends on a voltage Vgs between a gate electrode and a source electrode of the driving TFT DT, which is set in the programming period.

As described above, when a potential of the source electrode of the driving TFT DT is less than the initialization voltage Vinit in the programming period, the gate-source voltage Vgs of the driving TFT DT, which is set in the programming period, is greater than a desired value. Hence, the R, W, and B subpixels of the first unit pixel UPXL1 represent a luminance greater than a desired luminance. This problem is equally generated in R, W, G, and B subpixels of a second unit pixel UPXL2, which is vertically adjacent to the first unit pixel UPXL1 of FIG. 3 and is connected to the initialization voltage supply channel CH2.

FIG. 4 shows that luminances of the first and second unit pixels UPXL1 and UPXL2 are greater than a luminance of other unit pixel UPXL3 except the black spot resulting from the short circuit defect of the first unit pixel UPXL1. Further, in the existing sensing signal overlap drive method, in which sensing signals each having a pulse width of N horizontal periods NH (where N is a positive integer equal to or greater than 2) are shifted in the line sequential manner while overlapping each other by (N−1) horizontal period (N−1)H, N unit pixels, which are driven to overlap each other in response to the sensing signal among vertically adjacent unit pixels, are commonly connected to the same initialization voltage supply channel.

Therefore, when the short circuit defect is generated in one of the N unit pixels, the remaining unit pixels on other horizontal line vertically adjacent to the defective unit pixel are affected by the short circuit defect and represent an undesired luminance.

SUMMARY OF THE INVENTION

Accordingly, an object of the present invention is to address the above-noted and other problems.

Another object of the present invention is to provide a novel OLED capable of connecting different initialization voltage supply channels to horizontal pixel lines, which are driven to overlap each other, to prevent a luminance defect generated in one of the horizontal pixel lines from interfering in the remaining horizontal pixel lines.

To achieve these and other advantages and in accordance with the purpose of embodiments of the present invention, as embodied and broadly described herein, the present invention provides in one aspect an organic light emitting display including a display panel including sharing pixel groups each including at least one unit pixel; a gate driving circuit configured to generate sensing signals for initializing the unit pixels; and a data driving circuit configured to generate an initialization voltage to be applied to the unit pixels and output the initialization voltage through a plurality of initialization voltage supply channels. Further, when the sensing signals each having a pulse width of N horizontal periods (where N is a positive integer equal to or greater than 2) are shifted based on a line sequential manner while overlapping each other by (N−1) horizontal period, N initialization voltage supply channels are assigned to a plurality of vertically adjacent sharing pixel groups, and N sharing pixel groups which are driven to overlap each other in response to the sensing signals among the plurality of vertically adjacent sharing pixel groups, are connected to different initialization voltage supply channels.

In another aspect, the present invention provides an organic light emitting display including a display panel including a first unit pixel, which is initialized to an initialization voltage in response to a first sensing signal, and a second unit pixel, which is initialized to the initialization voltage in response to a second sensing signal overlapping the first sensing signal by a predetermined period of time; and a data driving circuit having a first initialization voltage supply channel, which is connected to the first unit pixel so as to supply the initialization voltage, and a second initialization voltage supply channel, which is connected to the second unit pixel so as to supply the initialization voltage.

In still another aspect, the present invention provides an organic light emitting display including a display panel including a first sharing pixel including at least two unit pixels, which are initialized to an initialization voltage in response to a first sensing signal, and a second sharing pixel including at least two unit pixels, which are initialized to the initialization voltage in response to a second sensing signal overlapping the first sensing signal by a predetermined period of time; and a data driving circuit having a first initialization voltage supply channel, which is connected to the first sharing pixel so as to supply the initialization voltage, and a second initialization voltage supply channel, which is connected to the second sharing pixel so as to supply the initialization voltage.

Further scope of applicability of the present invention will become apparent from the detailed description given hereinafter. However, it should be understood that the detailed description and specific examples, while indicating preferred embodiments of the invention, are given by illustration only, since various changes and modifications within the spirit and scope of the invention will become apparent to those skilled in the art from this detailed description.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENTS

Reference will now be made in detail to embodiments of the invention, examples of which are illustrated in the accompanying drawings. Wherever possible, the same reference numbers will be used throughout the drawings to refer to the same or like parts. It will be paid attention that detailed description of known arts will be omitted if it is determined that the arts can mislead the embodiments of the invention.

Figure 5:
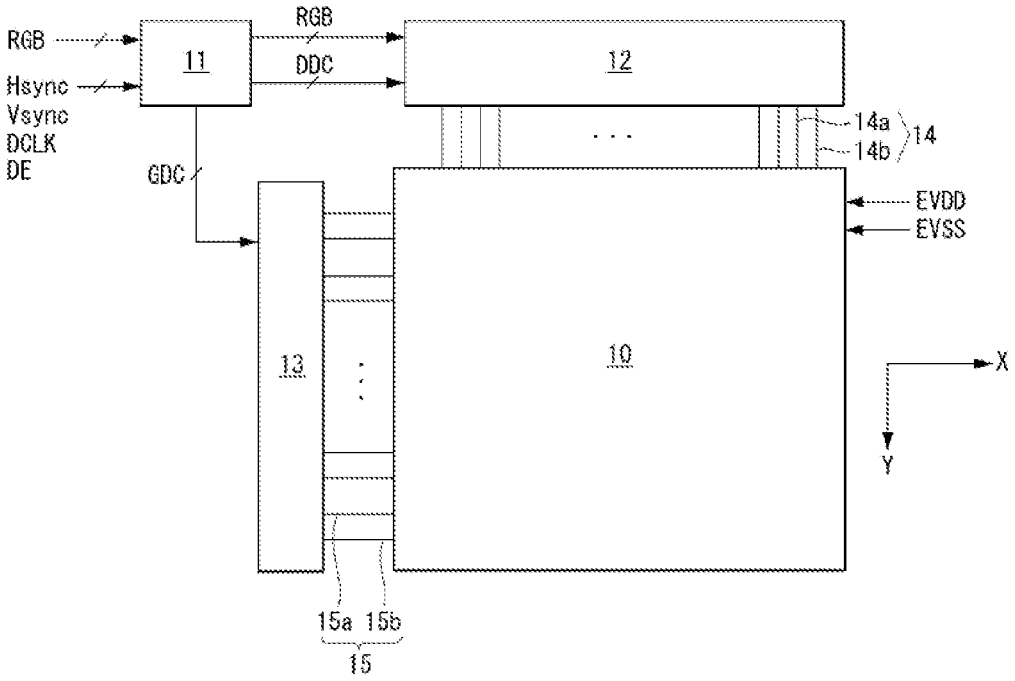
FIG. 5 is a block diagram illustrating an OLED according to an embodiment of the invention.

As shown in FIG. 5, an OLED according to an embodiment of the invention includes a display panel 10 including a plurality of unit pixels, a data driving circuit 12 for driving data lines 14 of the display panel 10, a gate driving circuit 13 for driving gate lines 15 of the display panel 10, and a timing controller 11 for controlling an operation timing of the data driving circuit 12 and the gate driving circuit 13.

The display panel 10 includes the plurality of data lines 14, the plurality of gate lines 15 crossing the data lines 14, and the plurality of unit pixels respectively positioned at crossings of the data lines 14 and the gate lines 15 in the matrix form. Each gate line 15 may include a scan signal supply line 15*a* and a sensing signal supply line 15*b*. Each data line 14 may include a data voltage supply line 14*a* and an initialization voltage supply line 14*b*.

Further, each unit pixel may include four subpixels each representing a different color, i.e., a first subpixel having a red (R) organic light emitting diode (OLED), a second subpixel having a green (G) OLED, a third subpixel having a blue (B) OLED, and a fourth subpixel having a white (W) OLED, but is not limited thereto. For example, each unit pixel may include three subpixels, i.e., a first subpixel having a red (R) OLED, a second subpixel having a green (G) OLED, and a third subpixel having a blue (B) OLED.

In addition, each subpixel receives a high potential cell driving voltage EVDD and a low potential cell driving voltage EVSS from a power generator and also receives a data voltage and an initialization voltage Vint from the data driving circuit 12. The initialization voltage Vint is a DC voltage determined between the high potential cell driving voltage EVDD and the low potential cell driving voltage EVSS.

In addition, the timing controller 11 rearranges digital video data RGB received from the outside in conformity with a resolution of the display panel 10 and supplies the rearranged digital video data RGB to the data driving circuit 12. The timing controller 11 generates a data control signal DDC for controlling operation timing of the data driving circuit 12 and a gate control signal GDC for controlling operation timing of the gate driving circuit 13 based on timing signals, such as a vertical sync signal Vsync, a horizontal sync signal Hsync, a dot clock DCLK, and a data enable signal DE.

The data driving circuit 12 converts the digital video data RGB received from the timing controller 11 into analog data voltages based on the data control signal DDC and then supplies the data voltages to the data voltage supply lines 14*a* through data voltage supply channels. For this, the data driving circuit 12 includes a digital-to-analog converter (DAC) shown in FIG. 6. The data driving circuit 12 generates the initialization voltage Vint and supplies the initialization voltage Vint to the initialization voltage supply lines 14*b* through initialization voltage supply channels.

In addition, the gate driving circuit 13 generates a scan signal and a sensing signal based on the gate control signal GDC. The gate driving circuit 13 supplies the scan signal to the scan signal supply lines 15*a* in a line sequential manner and also supplies the sensing signal to the sensing signal supply lines 15*b* in the line sequential manner. The scan signal may be supplied so that it does not overlap between the scan signal supply lines 15*a* based on the line sequential manner, but is not limited thereto.

Figure 9A:
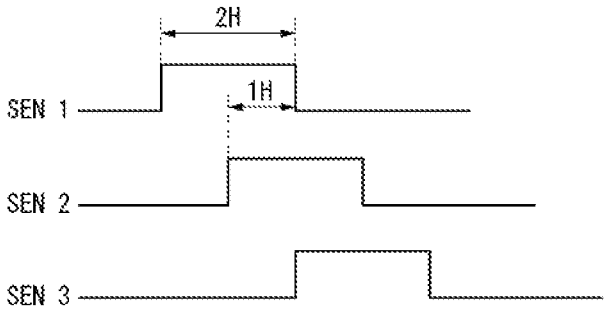
FIG. 9A is a waveform diagram illustrating a waveform of sensing signals for 1H overlap drive.
Figure 9B:
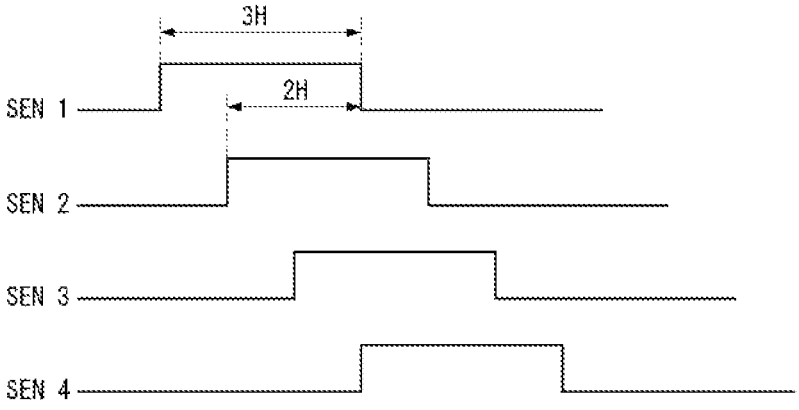
FIG. 9B is a waveform diagram illustrating a waveform of sensing signals for 2H overlap drive.
Figure 9C:
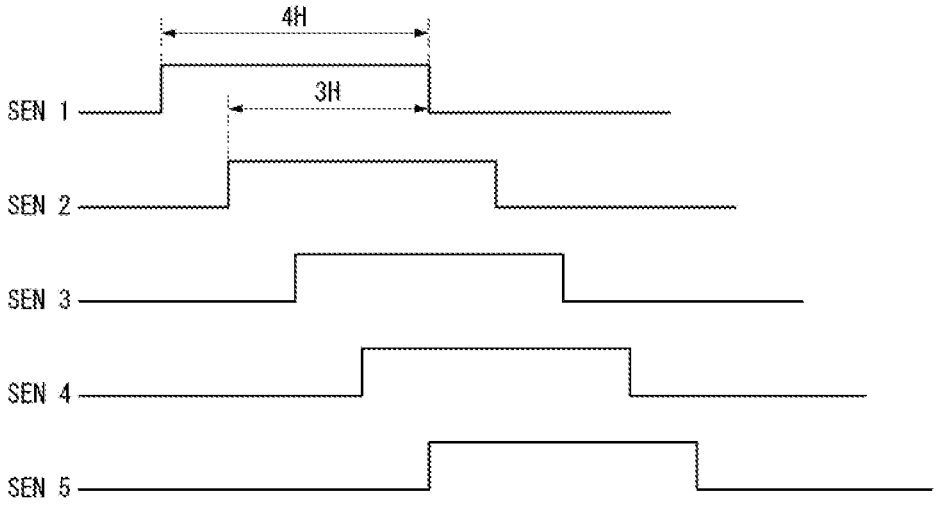
FIG. 9C is a waveform diagram illustrating a waveform of sensing signals for 3H overlap drive.

Further, as shown in FIGS. 9A to 9C, the sensing signals each have a pulse width of N horizontal periods and may be sequentially shifted based on the line sequential manner while overlapping each other by (N−1) horizontal period, where N is a positive integer equal to or greater than 2. The gate driving circuit 13 may be directly formed on the display panel 10 through a gate driver-in panel (GIP) process.

Figure 6:
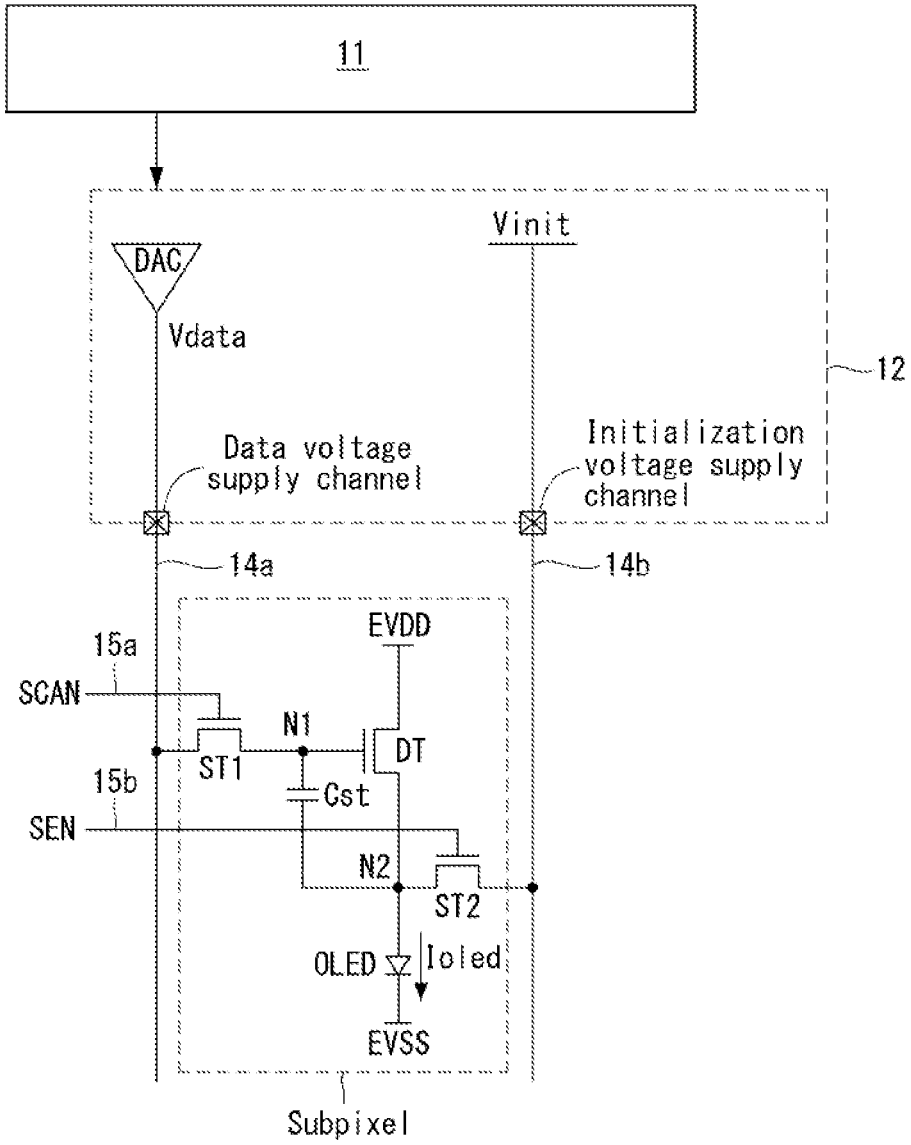
FIG. 6 is a circuit diagram illustrating a connection structure between a data driving circuit and a subpixel.

A detailed configuration of a subpixel applicable to the embodiment of the invention is described with reference to FIG. 6. As shown in FIG. 6, the subpixel includes an OLED, a driving thin film transistor (TFT) DT, a storage capacitor Cst, a first switch TFT ST1, and a second switch TFT ST2. Further, the OLED includes an anode electrode connected to a second node N2, a cathode electrode connected to an input terminal of the low potential cell driving voltage EVSS, and an organic compound layer positioned between the anode electrode and the cathode electrode.

The driving TFT DT controls a driving current Ioled flowing in the OLED depending on a gate-source voltage Vgs between a gate electrode and a source electrode of the driving TFT DT. The driving TFT DT includes the gate electrode connected to a first node N1, a drain electrode connected to an input terminal of the high potential cell driving voltage EVDD, and the source electrode connected to the second node N2.

The storage capacitor Cst is connected between the first node N1 and the second node N2. Also, the first switch TFT ST1 applies a data voltage Vdata on the data voltage supply line 14*a* to the first node N1 response to a scan signal SCAN. The first switch TFT ST1 includes a gate electrode connected to the scan signal supply line 15*a*, a drain electrode connected to the data voltage supply line 14*a*, and a source electrode connected to the first node N1.

The second switch TFT ST2 turns on a current flow between the second node N2 and the initialization voltage supply line 14*b* in response to a sensing signal SEN and thus supplies the initialization voltage Vinit to the second node N2. The second switch TFT ST2 includes a gate electrode connected to the sensing signal supply line 15*b*, a drain electrode connected to the second node N2, and a source electrode connected to the initialization voltage supply line 14*b*.

Figure 7:
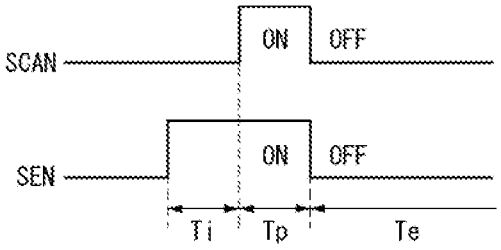
FIG. 7 is a waveform diagram illustrating a waveform of a gate signal for driving the subpixel of FIG. 6.

A detailed operation of the subpixel shown in FIG. 6 is described with reference to FIG. 7. The subpixel dividedly operates in an initialization period Ti, a programming period Tp, and an emission period Te, and three operations performed in the three periods are repeated in each frame period. In the initialization period Ti, the second switch TFT ST2 is turned on and initializes the second node N2 to the initialization voltage Vinit.

In the programming period Tp, the first switch TFT ST1 is turned on and supplies the data voltage Vdata to the first node N1. In the embodiment disclosed herein, the data voltage Vdata indicates the voltage, in which a threshold voltage and mobility are compensated through an external compensation method, which is previously performed. In the programming period Tp, because the second switch TFT ST2 is maintained in a turn-on state, the second node N2 is held at the initialization voltage Vinit. Thus, in the programming period Tp, the gate-source voltage Vgs of the driving TFT DT is programmed at a desired level.

In the emission period Te, the first and second switch TFTs ST1 and ST2 are turned off, and the driving TFT DT generates the driving current bled at the programmed level and applies the driving current bled to the OLED. The OLED represents grayscale at brightness corresponding to the driving current lobed.

The display panel 10 according to the embodiment of the invention includes a plurality of sharing pixel groups each including at least one unit pixel. Subpixels belonging to at least one unit pixel are connected to the same initialization voltage supply channel so as to form the sharing pixel group. In particular, in the embodiment of the invention, when the sensing signals SEN each having a pulse width of N horizontal periods NH (where N is a positive integer equal to or greater than 2) are shifted based on the line sequential manner while overlapping each other by (N−1) horizontal period (N−1)H, N initialization voltage supply channels are assigned to a plurality of sharing pixel groups which are adjacent to one another in a vertical direction, for example, in Y-axis direction of FIG. 5.

According to a sensing signal overlap drive, N sharing pixel groups, which are driven to overlap each other in response to the sensing signals SEN among the plurality of vertically adjacent sharing pixel groups, are characterized as being connected to different initialization voltage supply channels as shown in FIGS. 10 to 15.

As described above, in the embodiment of the invention, N unit pixels, which are driven to overlap each other in response to the sensing signal SEN among vertically adjacent unit pixels, are not commonly connected to the same initialization voltage supply channel and are respectively connected to different initialization voltage supply channels. Therefore, even if a short circuit defect is generated in one of the N unit pixels, remaining unit pixels on other horizontal pixel lines, which are vertically adjacent to the defective unit pixel among the N unit pixels, are not affected by the short circuit defect. Thus, the embodiment of the invention may further improve the image quality, as compared with the related art.

Figure 8A:
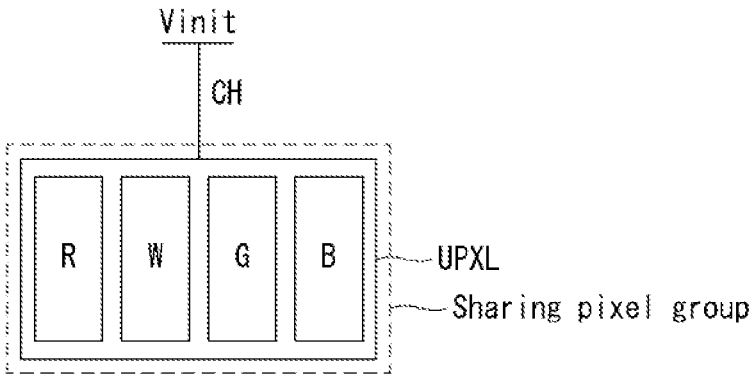
FIG. 8A is an overview illustrating an example of a sharing pixel group according to an embodiment of the invention.
Figure 8B:
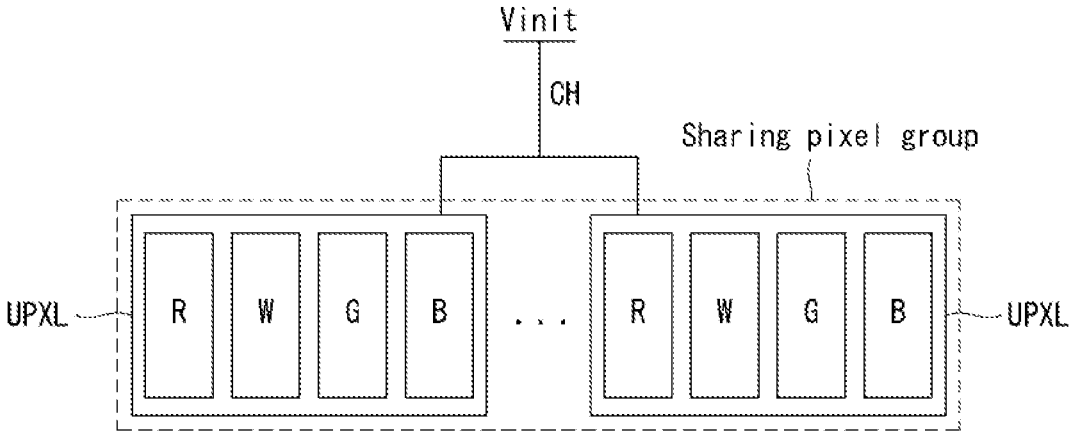
FIG. 8B is an overview illustrating another example of a sharing pixel group according to an embodiment of the invention.

Next, FIGS. 8A and 8B are overviews illustrating examples of a sharing pixel group according to the embodiment of the invention. The sharing pixel group according to the embodiment of the invention is defined as at least one unit pixel UPXL, which is connected to the same initialization voltage supply channel and simultaneously receives the initialization voltage Vinit in response to the sensing signal. Each unit pixel UPXL includes a plurality of subpixels.

As shown in FIG. 8A, the sharing pixel group according to the embodiment of the invention may include one unit pixel UPXL including R, W, G, and B subpixels, which are connected to the same initialization voltage supply channel CH. Further, as shown in FIG. 8B, the sharing pixel group according to the embodiment of the invention may include N unit pixels UPXL each including R, W, G, and B subpixels, which are connected to the same initialization voltage supply channel CH. The N unit pixels UPXL constituting the sharing pixel group may be adjacent to one another in a horizontal direction, for example, in X-axis direction of FIG. 5.

Figure 1:
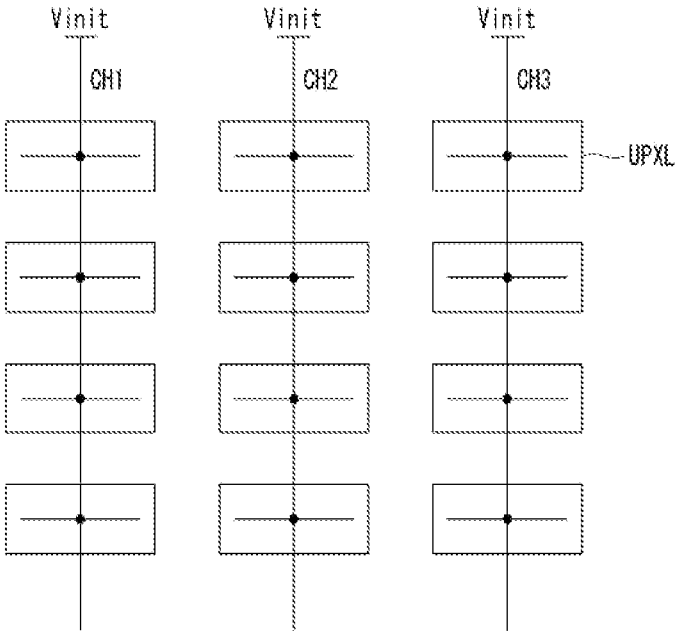
FIG. 1 (RELATED ART)
FIG. 1 is an overview illustrating a connection between related art unit pixels and initialization voltage supply channels.
Figure 2:
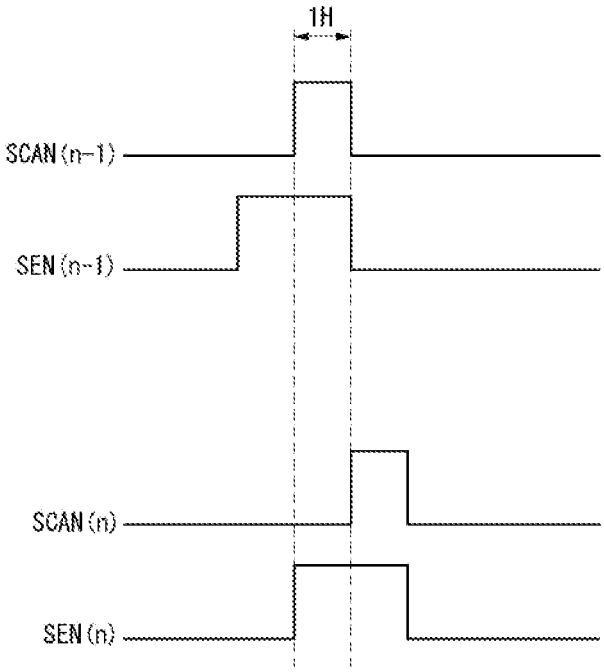
FIG. 2 (RELATED ART)
FIG. 2 is a timing diagram illustrating a related art sensing signal overlap drive method.
Figure 3:
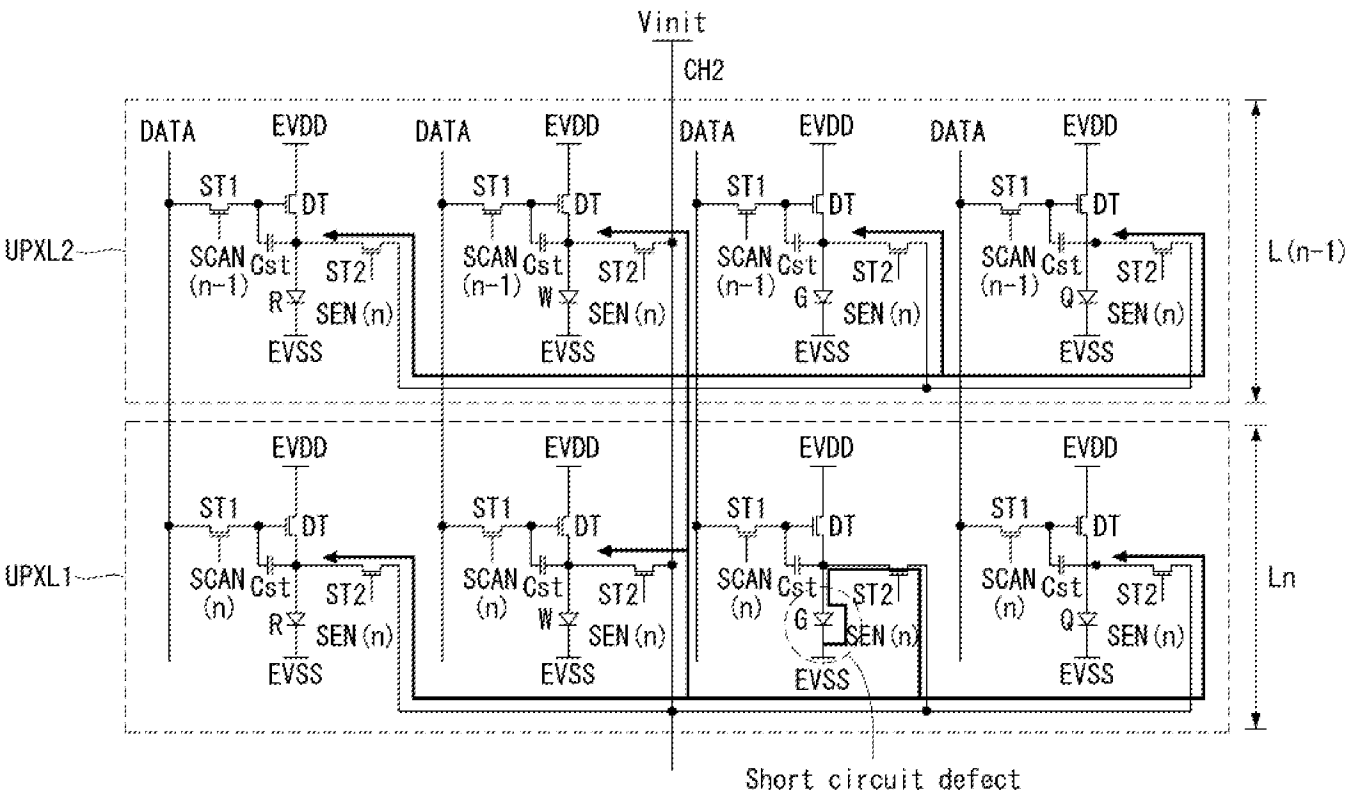
FIG. 3 (RELATED ART)
FIG. 3 is a circuit diagram illustrating how a short circuit defect generated in one subpixel disposed on a predetermined horizontal pixel line affects other horizontal pixel line in the related art sensing signal overlap drive method.
Figure 4:
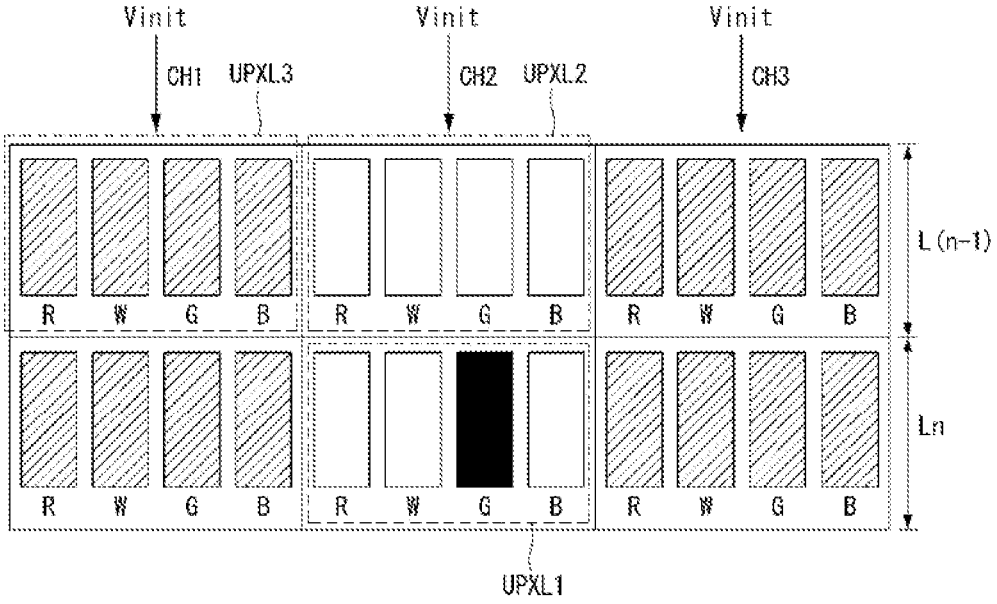
FIG. 4 (RELATED ART)
FIG. 4 is a diagram illustrating a luminance defect resulting from the short circuit defect illustrated in FIG. 3.

FIGS. 9A to 9C show various examples of the sensing signal overlap drive. As described above, the sensing signal is sequentially supplied to the horizontal pixel lines in the line sequential manner in the same manner as the scan signal. For example, as shown in FIG. 2, a sensing signal SEN(n−1) may be supplied to an (n−1)th horizontal pixel line L(n−1), and a sensing signal SEN(n) may be supplied to an nth horizontal pixel line L(n). The successively shifted sensing signals SEN overlap each other by a predetermined period of time based on the sensing signal overlap drive. The sensing signal overlap drive depends on an overlap width (i.e., an overlap horizontal period) between the adjacent sensing signals. For example, the sensing signal overlap drive may be classified into 1H overlap drive shown in FIG. 9A, 2H overlap drive shown in FIG. 9B, and 3H overlap drive shown in FIG. 9C depending on the overlap width between the adjacent sensing signals, but is not limited thereto.

In the 1H overlap drive shown in FIG. 9A, sensing signals SEN1 to SEN3 each having a pulse width of two horizontal periods 2H are sequentially shifted in the line sequential manner while overlapping each other by one horizontal period 1H. In the embodiment disclosed herein, the sensing signals SEN1 to SEN3 are applied to subpixels disposed on horizontal pixel lines L#1 to L#3 shown in FIGS. 10 and 13.

In the 2H overlap drive shown in FIG. 9B, sensing signals SEN1 to SEN4 each having a pulse width of three horizontal periods 3H are sequentially shifted in the line sequential manner while overlapping each other by two horizontal periods 2H. In the embodiment disclosed herein, the sensing signals SEN1 to SEN4 are applied to subpixels disposed on horizontal pixel lines L#1 to L#4 shown in FIGS. 11 and 14.

In the 3H overlap drive shown in FIG. 9C, sensing signals SEN1 to SEN5 each having a pulse width of four horizontal periods 4H are sequentially shifted in the line sequential manner while overlapping each other by three horizontal periods 3H. In the embodiment disclosed herein, the sensing signals SEN1 to SEN5 are applied to subpixels disposed on horizontal pixel lines L#1 to L#5 shown in FIGS. 12 and 15.

Figure 10:
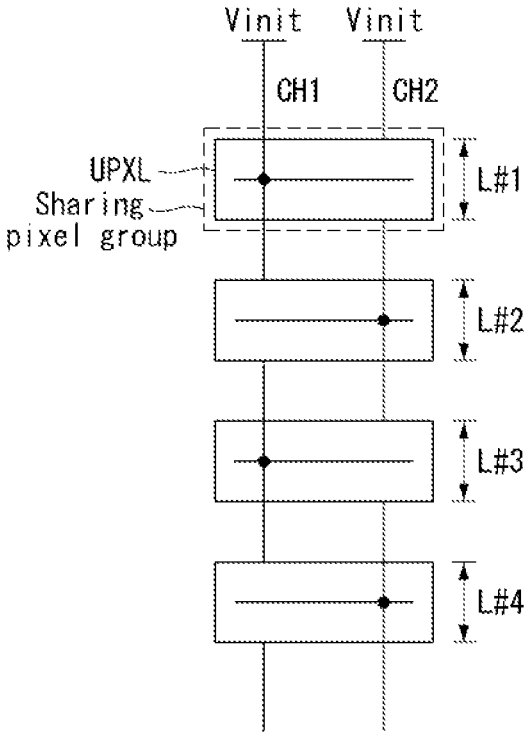
FIG. 10 is an overview illustrating an example of a connection between vertically adjacent sharing pixel groups and initialization voltage supply channels in 1H overlap drive.
Figure 11:
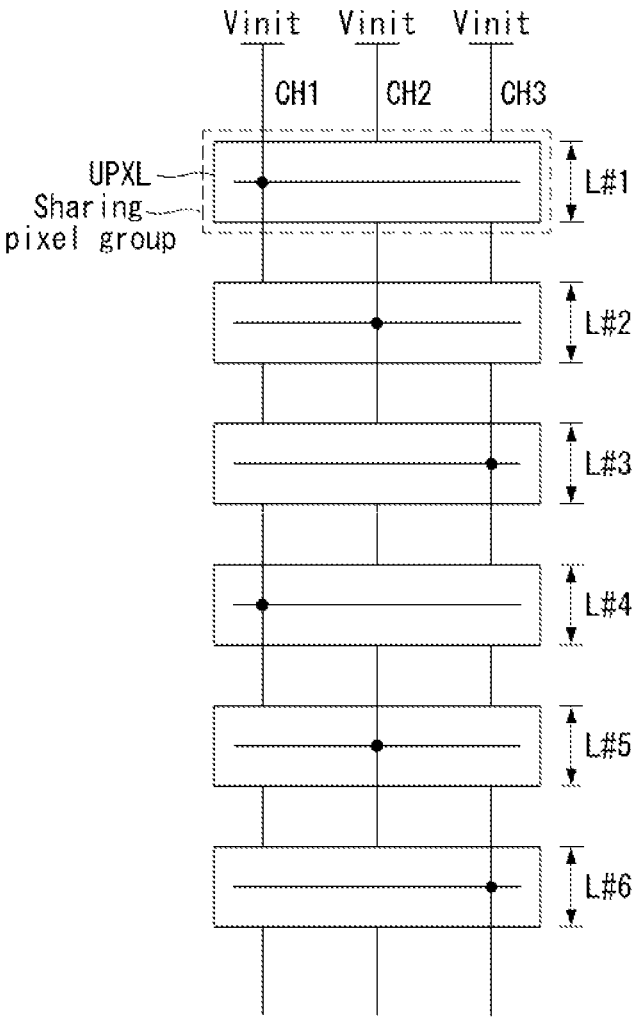
FIG. 11 is an overview illustrating an example of a connection between vertically adjacent sharing pixel groups and initialization voltage supply channels in 2H overlap drive.
Figure 12:
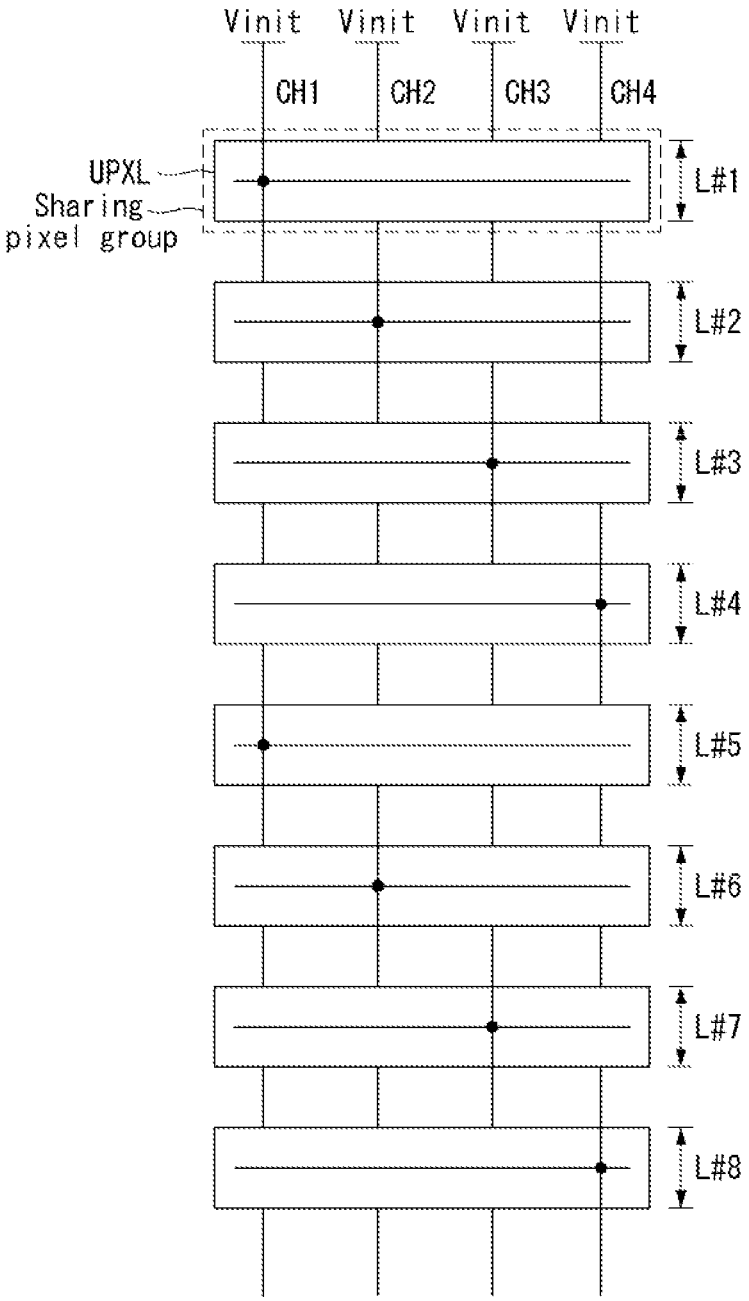
FIG. 12 is an overview illustrating an example of a connection between vertically adjacent sharing pixel groups and initialization voltage supply channels in 3H overlap drive.

In more detail, FIGS. 10 to 12 are overview illustrating examples of a connection between vertically adjacent sharing pixel groups and the initialization voltage supply channels when one unit pixel UPXL constitutes a sharing pixel group. The connection examples shown in FIGS. 10 to 12 correspond to the sensing signal overlap drives shown in FIGS. 9A to 9C, respectively.

In the 1H overlap drive shown in FIG. 9A, in which the sensing signals SEN1 to SEN3 each having the pulse width of two horizontal periods 2H are sequentially shifted while overlapping each other by one horizontal period 1H, two initialization voltage supply channels CH1 and CH2 are assigned to a plurality of vertically adjacent sharing pixel groups as shown in FIG. 10. The sharing pixel groups disposed on (2m−1)th horizontal pixel lines L#1 and L#3 among the vertically adjacent sharing pixel groups are connected to the first initialization voltage supply channel CH1 of the two initialization voltage supply channels, where m is a positive integer. The sharing pixel groups disposed on (2m)th horizontal pixel lines L#2 and L#4 among the vertically adjacent sharing pixel groups are connected to the second initialization voltage supply channel CH2 of the two initialization voltage supply channels.

In the 2H overlap drive shown in FIG. 9B, in which the sensing signals SEN1 to SEN4 each having the pulse width of three horizontal periods 3H are sequentially shifted while overlapping each other by two horizontal periods 2H, three initialization voltage supply channels CH1, CH2, and CH3 are assigned to the plurality of vertically adjacent sharing pixel groups as shown in FIG. 11. The sharing pixel groups disposed on (3m−2)th horizontal pixel lines L#1 and L#4 among the vertically adjacent sharing pixel groups are connected to the first initialization voltage supply channel CH1 of the three initialization voltage supply channels.

The sharing pixel groups disposed on (3m−1)th horizontal pixel lines L#2 and L#5 among the vertically adjacent sharing pixel groups are connected to the second initialization voltage supply channel CH2 of the three initialization voltage supply channels. The sharing pixel groups disposed on (3m)th horizontal pixel lines L#3 and L#6 among the vertically adjacent sharing pixel groups are connected to the third initialization voltage supply channel CH3 of the three initialization voltage supply channels.

In the 3H overlap drive shown in FIG. 9C, in which the sensing signals SEN1 to SEN5 each having the pulse width of four horizontal periods 4H are sequentially shifted while overlapping each other by three horizontal periods 3H, four initialization voltage supply channels CH1, CH2, CH3, and CH4 are assigned to the plurality of vertically adjacent sharing pixel groups as shown in FIG. 12. The sharing pixel groups disposed on (4m−3)th horizontal pixel lines L#1 and L#5 among the vertically adjacent sharing pixel groups are connected to the first initialization voltage supply channel CH1 of the four initialization voltage supply channels.

The sharing pixel groups disposed on (4m−2)th horizontal pixel lines L#2 and L#6 among the vertically adjacent sharing pixel groups are connected to the second initialization voltage supply channel CH2 of the four initialization voltage supply channels. The sharing pixel groups disposed on (4m−1)th horizontal pixel lines L'3 and L#7 among the vertically adjacent sharing pixel groups are connected to the third initialization voltage supply channel CH3 of the four initialization voltage supply channels. The sharing pixel groups disposed on (4m)th horizontal pixel lines L#4 and L#8 among the vertically adjacent sharing pixel groups are connected to the fourth initialization voltage supply channel CH4 of the four initialization voltage supply channels.

As described above, FIGS. 10 to 12 show the examples of fixing the number of unit pixels constituting one sharing pixel group to one and increasing the number of initialization voltage supply channels assigned to one sharing pixel group (i.e., one unit pixel) in proportion to an increase in the pulse width and the overlap width of the sensing signals. Because the initialization voltage supply channels are formed in the data driving circuit, an increase in the number of initialization voltage supply channels results in an increase in the size of the data driving circuit.

Figure 13:
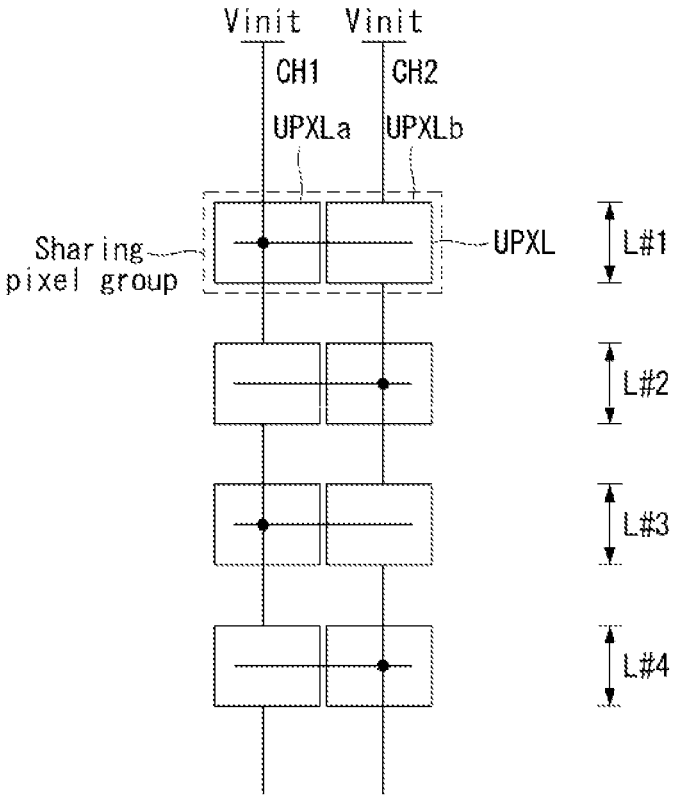
FIG. 13 is an overview illustrating another example of a connection between vertically adjacent sharing pixel groups and initialization voltage supply channels in 1H overlap drive.
Figure 14:
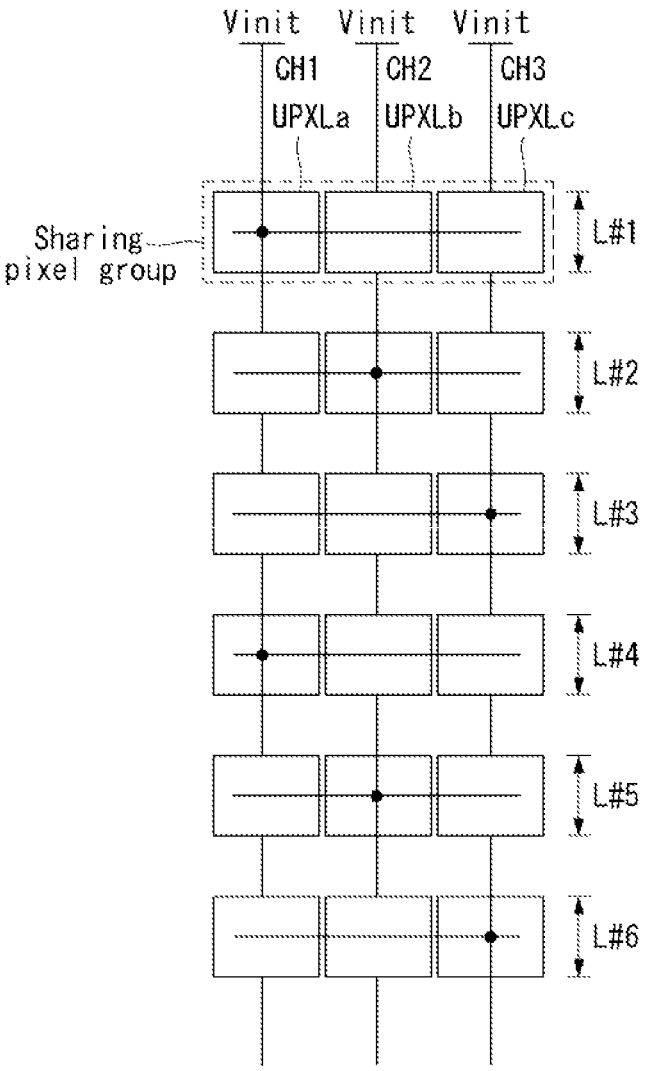
FIG. 14 is an overview illustrating another example of a connection between vertically adjacent sharing pixel groups and initialization voltage supply channels in 2H overlap drive.
Figure 15:
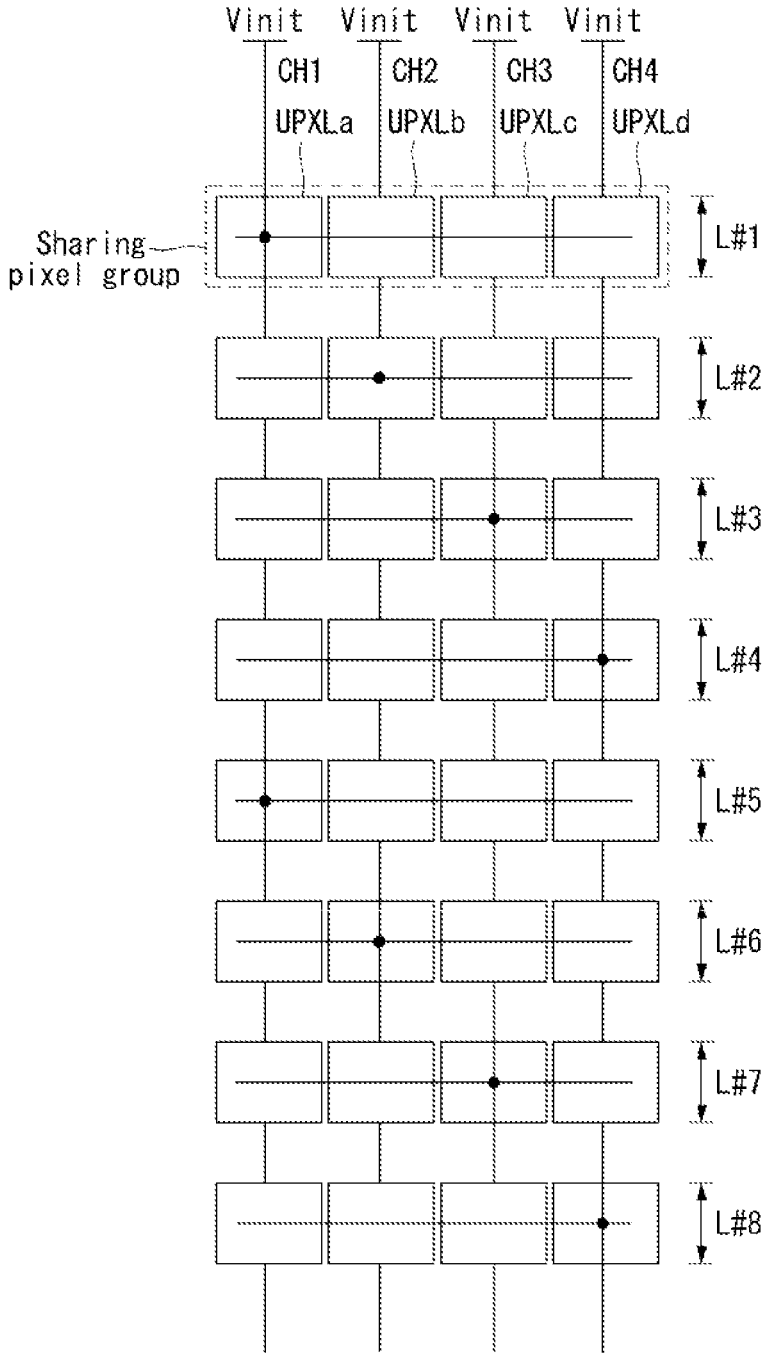
FIG. 15 is an overview illustrating another example of a connection between vertically adjacent sharing pixel groups and initialization voltage supply channels in 3H overlap drive.

Next, FIGS. 13 to 15 are overviews illustrating examples of a connection between vertically adjacent sharing pixel groups and the initialization voltage supply channels when N unit pixels UPXL constitute a sharing pixel group. The connection examples shown in FIGS. 13 to 15 correspond to the sensing signal overlap drives shown in FIGS. 9A to 9C, respectively.

More specifically, FIG. 13 shows an example of a connection between vertically adjacent sharing pixel groups and the initialization voltage supply channels when two unit pixels UPXLa and UPXLb constitute one sharing pixel group. The connection example shown in FIG. 13 corresponds to the 1H overlap drive shown in FIG. 9A. In the 1H overlap drive shown in FIG. 9A, in which the sensing signals SEN1 to SEN3 each having the pulse width of two horizontal periods 2H are sequentially shifted while overlapping each other by one horizontal period 1H, two initialization voltage supply channels CH1 and CH2 are assigned to a plurality of vertically adjacent sharing pixel groups as shown in FIG. 13.

The sharing pixel groups disposed on (2m−1)th horizontal pixel lines L#1 and L#3 among the vertically adjacent sharing pixel groups are connected to the first initialization voltage supply channel CH1 of the two initialization voltage supply channels, where m is a positive integer. The sharing pixel groups disposed on (2m)th horizontal pixel lines L#2 and L#4 among the vertically adjacent sharing pixel groups are connected to the second initialization voltage supply channel CH2 of the two initialization voltage supply channels.

FIG. 14 is an overview illustrating an example of a connection between vertically adjacent sharing pixel groups and the initialization voltage supply channels when three unit pixels UPXLa, UPXLb, and UPXLc constitute one sharing pixel group. The connection example shown in FIG. 14 corresponds to the 2H overlap drive shown in FIG. 9B. In the 2H overlap drive shown in FIG. 9B, in which the sensing signals SEN1 to SEN4 each having the pulse width of three horizontal periods 3H are sequentially shifted while overlapping each other by two horizontal periods 2H, three initialization voltage supply channels CH1, CH2, and CH3 are assigned to the plurality of vertically adjacent sharing pixel groups as shown in FIG. 14.

The sharing pixel groups disposed on (3m−2)th horizontal pixel lines L#1 and L#4 among the vertically adjacent sharing pixel groups are connected to the first initialization voltage supply channel CH1 of the three initialization voltage supply channels. The sharing pixel groups disposed on (3m−1)th horizontal pixel lines L#2 and L#5 among the vertically adjacent sharing pixel groups are connected to the second initialization voltage supply channel CH2 of the three initialization voltage supply channels. The sharing pixel groups disposed on (3m)th horizontal pixel lines L#3 and L#6 among the vertically adjacent sharing pixel groups are connected to the third initialization voltage supply channel CH3 of the three initialization voltage supply channels.

Next, FIG. 15 is an overview illustrating an example of a connection between vertically adjacent sharing pixel groups and the initialization voltage supply channels when four unit pixels UPXLa, UPXLb, UPXLc, and UPXLd constitute one sharing pixel group. The connection example shown in FIG. 15 corresponds to the 3H overlap drive shown in FIG. 9C. In the 3H overlap drive shown in FIG. 9C, in which the sensing signals SEN1 to SEN5 each having the pulse width of four horizontal periods 4H are sequentially shifted while overlapping each other by three horizontal periods 3H, four initialization voltage supply channels CH1, CH2, CH3, and CH4 are assigned to the plurality of vertically adjacent sharing pixel groups as shown in FIG. 15.

The sharing pixel groups disposed on (4m−3)th horizontal pixel lines L#1 and L#5 among the vertically adjacent sharing pixel groups are connected to the first initialization voltage supply channel CH1 of the four initialization voltage supply channels. The sharing pixel groups disposed on (4m−2)th horizontal pixel lines L#2 and L#6 among the vertically adjacent sharing pixel groups are connected to the second initialization voltage supply channel CH2 of the four initialization voltage supply channels.

The sharing pixel groups disposed on (4m−1)th horizontal pixel lines L#3 and L#7 among the vertically adjacent sharing pixel groups are connected to the third initialization voltage supply channel CH3 of the four initialization voltage supply channels. The sharing pixel groups disposed on (4m)th horizontal pixel lines L#4 and L#8 among the vertically adjacent sharing pixel groups are connected to the fourth initialization voltage supply channel CH4 of the four initialization voltage supply channels.

As described above, FIGS. 13 to 15 show examples of fixing the number of initialization voltage supply channels assigned to one unit pixel to one and increasing the number of unit pixels constituting one sharing pixel group in proportion to an increase in the pulse width and the overlap width of the sensing signals. Even if an increase in the number of unit pixels constituting one sharing pixel group results in an increase in the number of initialization voltage supply channels assigned to one sharing pixel group, the number of initialization voltage supply channels assigned to one unit pixel is fixed to one. Therefore, an increase in the size of the data driving circuit is not necessary.

As described above, the embodiment of the invention connects the different initialization voltage supply channels to the horizontal pixel lines, which are driven to overlap each other in response to the overlapping sensing signals, thereby preventing the luminance defect generated in one of the horizontal pixel lines from interfering in the remaining horizontal pixel lines.

Embodiments of the present invention encompass various modifications to each of the examples and embodiments discussed herein. According to the invention, one or more features described above in one embodiment or example can be equally applied to another embodiment or example described above. The features of one or more embodiments or examples described above can be combined into each of the embodiments or examples described above. Any full or partial combination of one or more embodiment or examples of the invention is also part of the invention.

Although embodiments have been described with reference to a number of illustrative embodiments thereof, it should be understood that numerous other modifications and embodiments can be devised by those skilled in the art that will fall within the scope of the principles of this invention. More particularly, various variations and modifications are possible in the component parts and/or arrangements of the subject combination arrangement within the scope of the invention, the drawings and the appended claims. In addition to variations and modifications in the component parts and/or arrangements, alternative uses will also be apparent to those skilled in the art.

What is claimed is:

1. An organic light emitting display comprising:

a display panel including sharing pixel groups each including at least one unit pixel;

a gate driving circuit configured to generate sensing signals for initializing the unit pixels; and a data driving circuit configured to generate an initialization voltage to be applied to the unit pixels and output the initialization voltage through a plurality of initialization voltage supply channels, wherein when the sensing signals each having a pulse width of N horizontal periods (where N is a positive integer equal to or greater than 2) are shifted based on a line sequential manner while overlapping each other by (N−1) horizontal period, N initialization voltage supply channels are assigned to a plurality of vertically adjacent sharing pixel groups, and wherein N sharing pixel groups which are driven to overlap each other in response to the sensing signals among the plurality of vertically adjacent sharing pixel groups, are connected to different initialization voltage supply channels.

2. The organic light emitting display of claim 1, wherein when the sensing signals each having the pulse width of two horizontal periods are shifted while overlapping each other by one horizontal period, two initialization voltage supply channels are assigned to the plurality of vertically adjacent sharing pixel groups, wherein sharing pixel groups disposed on (2m−1)th horizontal pixel lines (where m is a positive integer) among the plurality of vertically adjacent sharing pixel groups are connected to a first initialization voltage supply channel of the two initialization voltage supply channels, and wherein sharing pixel groups disposed on (2m)th horizontal pixel lines among the plurality of vertically adjacent sharing pixel groups are connected to a second initialization voltage supply channel of the two initialization voltage supply channels.

3. The organic light emitting display of claim 1, wherein when the sensing signals each having the pulse width of three horizontal periods are shifted while overlapping each other by two horizontal periods, three initialization voltage supply channels are assigned to the plurality of vertically adjacent sharing pixel groups, wherein sharing pixel groups disposed on (3m−2)th horizontal pixel lines (where m is a positive integer) among the plurality of vertically adjacent sharing pixel groups are connected to a first initialization voltage supply channel of the three initialization voltage supply channels, wherein sharing pixel groups disposed on (3m−1)th horizontal pixel lines among the plurality of vertically adjacent sharing pixel groups are connected to a second initialization voltage supply channel of the three initialization voltage supply channels, and wherein sharing pixel groups disposed on (3m)th horizontal pixel lines among the plurality of vertically adjacent sharing pixel groups are connected to a third initialization voltage supply channel of the three initialization voltage supply channels.

4. The organic light emitting display of claim 1, wherein when the sensing signals each having the pulse width of four horizontal periods are shifted while overlapping each other by three horizontal periods, four initialization voltage supply channels are assigned to the plurality of vertically adjacent sharing pixel groups, wherein sharing pixel groups disposed on (4m−3)th horizontal pixel lines (where m is a positive integer) among the plurality of vertically adjacent sharing pixel groups are connected to a first initialization voltage supply channel of the four initialization voltage supply channels, wherein sharing pixel groups disposed on (4m−2)th horizontal pixel lines among the plurality of vertically adjacent sharing pixel groups are connected to a second initialization voltage supply channel of the four initialization voltage supply channels, wherein sharing pixel groups disposed on (4m−1)th horizontal pixel lines among the plurality of vertically adjacent sharing pixel groups are connected to a third initialization voltage supply channel of the four initialization voltage supply channels, and wherein sharing pixel groups disposed on (4m)th horizontal pixel lines among the plurality of vertically adjacent sharing pixel groups are connected to a fourth initialization voltage supply channel of the four initialization voltage supply channels.

5. The organic light emitting display of claim 1, wherein each of the sharing pixel groups includes one unit pixel, and the one unit pixel includes a plurality of subpixels.

6. The organic light emitting display of claim 1, wherein each of the sharing pixel groups includes N horizontally adjacent unit pixels, and each of the N horizontally adjacent unit pixels includes a plurality of subpixels.

7. An organic light emitting display comprising:

a display panel including a first unit pixel, which is initialized to an initialization voltage in response to a first sensing signal, and a second unit pixel, which is initialized to the initialization voltage in response to a second sensing signal overlapping the first sensing signal by a predetermined period of time; and a data driving circuit having a first initialization voltage supply channel, which is connected to the first unit pixel so as to supply the initialization voltage, and a second initialization voltage supply channel, which is connected to the second unit pixel so as to supply the initialization voltage, wherein the display panel further includes a third unit pixel, which is initialized to the initialization voltage in response to a third sensing signal, and a fourth unit pixel, which is initialized to the initialization voltage in response to a fourth sensing signal overlapping the third sensing signal by the predetermined period of time, and wherein the first initialization voltage supply channel is connected to the third unit pixel so as to supply the initialization voltage, and the second initialization voltage supply channel is connected to the fourth unit pixel so as to supply the initialization voltage.

8. An organic light emitting display comprising:

a display panel including a first sharing pixel including at least two unit pixels, which are initialized to an initialization voltage in response to a first sensing signal, and a second sharing pixel including at least two unit pixels, which are initialized to the initialization voltage in response to a second sensing signal overlapping the first sensing signal by a predetermined period of time; and a data driving circuit having a first initialization voltage supply channel, which is connected to the first sharing pixel so as to supply the initialization voltage, and a second initialization voltage supply channel, which is connected to the second sharing pixel so as to supply the initialization voltage.

9. The organic light emitting display of claim 8, wherein the first sharing pixel includes three unit pixels, and the second sharing pixel include three unit pixels, wherein the display panel further includes a third sharing pixel including three unit pixels, and wherein the data driving circuit further includes a third initialization voltage supply channel, which is connected to the third sharing pixel so as to supply the initialization voltage.

10. The organic light emitting display of claim 8, wherein the first sharing pixel includes four unit pixels, and the second sharing pixel include four unit pixels, wherein the display panel further includes third and fourth sharing pixels each including four unit pixels, and wherein the data driving circuit further includes third and fourth initialization voltage supply channel, which are respectively connected to the third and fourth sharing pixels so as to supply the initialization voltage.

* * * * *